US007361056B1

(12) United States Patent
Liu

(10) Patent No.: US 7,361,056 B1
(45) Date of Patent: Apr. 22, 2008

(54) MICRO COMBINED CONNECTOR STRUCTURE

(75) Inventor: Ming-Ren Liu, Taoyuan (TW)

(73) Assignee: Amphenol East Asia Limited (H.K.), Taoyuan County (TW)

( * ) Notice: Subject to any disclaimer, the term of this patent is extended or adjusted under 35 U.S.C. 154(b) by 0 days.

(21) Appl. No.: 11/589,283

(22) Filed: Oct. 30, 2006

(51) Int. Cl.
*H01R 24/00* (2006.01)

(52) U.S. Cl. ..... 439/630

(58) Field of Classification Search ..... 439/631, 439/630

See application file for complete search history.

(56) References Cited

U.S. PATENT DOCUMENTS 5,718,609 A * 2/1998 Braun et al. ..... 439/630
6,468,101 B2 * 10/2002 Suzuki ..... 439/326
6,623,304 B2 * 9/2003 Harasawa et al. ..... 439/630
6,863,537 B2 * 3/2005 Pellizari ..... 439/31
7,066,755 B2 * 6/2006 Laitinen ..... 439/326
7,232,325 B2 * 6/2007 Richter et al. ..... 439/326
2005/0136737 A1 * 6/2005 Laitinen ..... 439/607
2006/0099855 A1 * 5/2006 Richter et al. ..... 439/630

* cited by examiner

*Primary Examiner*—John R. Lee
(74) *Attorney, Agent, or Firm*—Troxell Law Office, PLLC

(57) ABSTRACT

The present invention provides an improved micro combined connector structure, wherein a connector is structured to include a base, a cover, a movable cover and an earth strip. The base is provided with first and second containing recesses disposed therein, wherein the first containing recess enables electrical connecting to a SIM (Subscriber Identity Module) card, and the second containing recess enables electrical connecting to a memory card. A movable cover is fittingly disposed corresponding to position of the second containing recess of the base, and a protruding piece is located on the movable cover corresponding to the earth strip located on a side of the base. Closing of the movable cover enables the protruding piece and the earth strip to make contact and produce an electrical conduction, thereby enabling the movable cover to form an earthing state to achieve the objective of preventing interference and reducing noise.

5 Claims, 8 Drawing Sheets

MICRO COMBINED CONNECTOR STRUCTURE

BACKGROUND OF THE INVENTION (a) Field of the Invention

The present invention relates to an improved micro combined connector structure, and more particularly to a connector enabling a SIM (Subscriber Identify Module) card and a memory card to be inserted therein.

(b) Description of the Prior Art

A connector of prior art has a structure enabling a memory card to be directly disposed on terminals of a containing recess, whereupon an upper cover press fits and thereby fixedly clasps the memory card. However, the direct press fitting method of the upper cover easily results in the upper cover opening due to inadvertent knocking when in use, thereby resulting in the inability to effect normal electrical connection between the memory card and the terminals, or results in the memory card coming loose leading to loss thereof.

Furthermore, a connector of prior art that has not been provided with earthing means, and thus easily results in noise interference occurring when in use, which further causes the connector to produce problems of wrong access to the memory card.

Hence, the inventor of the present invention proposes to resolve and surmount existent technical difficulties to eliminate the aforementioned shortcomings of prior art.

SUMMARY OF THE INVENTION

The art of the present invention provides an improved micro combined connector structure, and more particularly provides a connector enabling a SIM (Subscriber Identify Module) card and a memory card to be inserted therein, moreover, the connector is disposed with an earth strip that enables achieving the objective of preventing interference and reduce noise.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
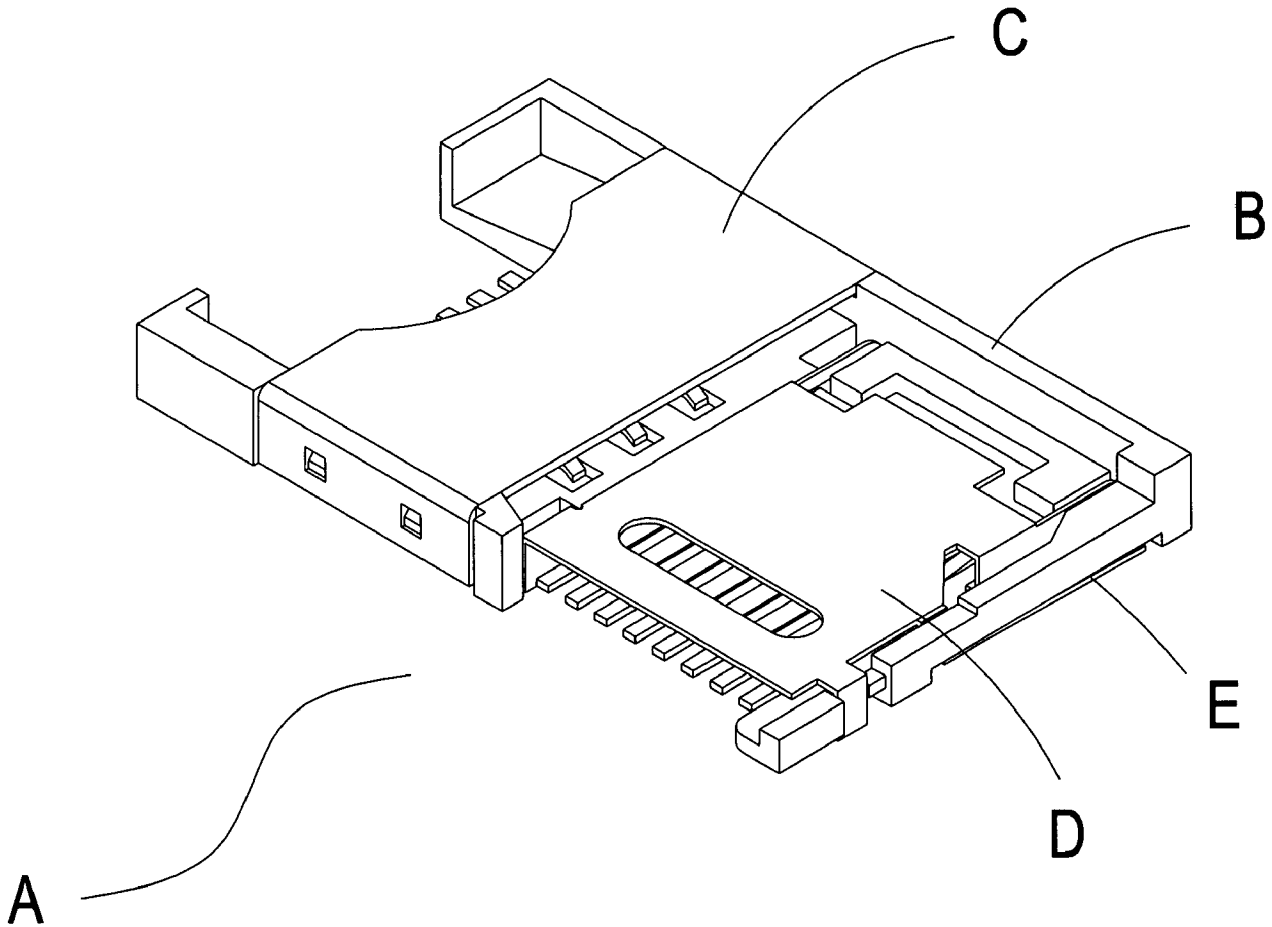
FIG. 1 shows an elevational view according to the present invention.
Figure 2:
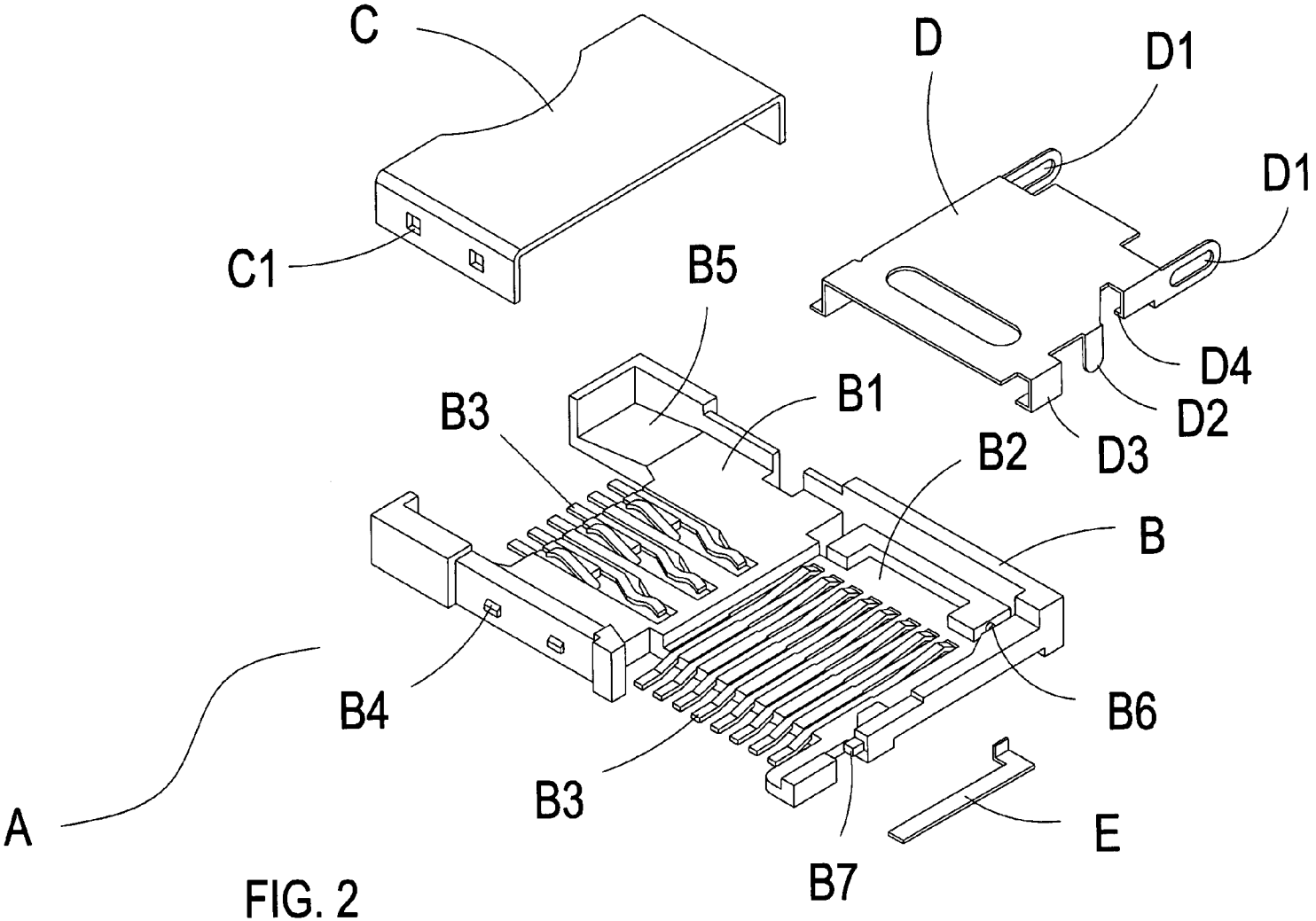
FIG. 2 shows an exploded elevational view according to the present invention.

Referring to FIG. 1 and FIG. 2, which show an improved micro combined connector structure of the present invention provides, wherein a connector A is structured to primarily comprise a base B, a cover piece C, a movable cover D and an earth strip E. A first containing recess B1 and a second containing recess B2 are defined in the base B, and a plurality of terminals B3 are respectively configured within the first containing recess B1 and the second containing recess B2. A plurality of protuberances B4 and bilateral oblique portions B5 are located on the first containing recess B1, and bilateral protruding shafts B6 and a protruding rail B7 are located on the second containing recess B2. Accordingly, the cover piece C is disposed on the first containing recess B1, and a plurality of through holes C1 defined in the cover piece C respectively join with the corresponding protuberances B4 of the first containing recess B1. Furthermore, the movable cover D is fittingly disposed on the second containing recess B2, and bilateral arc holes D1 defined in the movable cover D are used to respectively join with the corresponding protruding shafts B6 of the second containing recess B2.

A protruding piece D2, a fastening member D3 and a plurality of clasp fastening members D4 are located on the movable cover D. The earth strip E is fittingly disposed on a side of the second containing recess B2 corresponding to position of the protruding piece D2 of the movable cover D.

When the movable cover D is closed, contact between the protruding piece D2 and the earth strip E effects an electrical connection, thereby enabling the movable cover D to assume an earthing state, thus achieving the objective of preventing interference and reducing noise.

Figure 3:
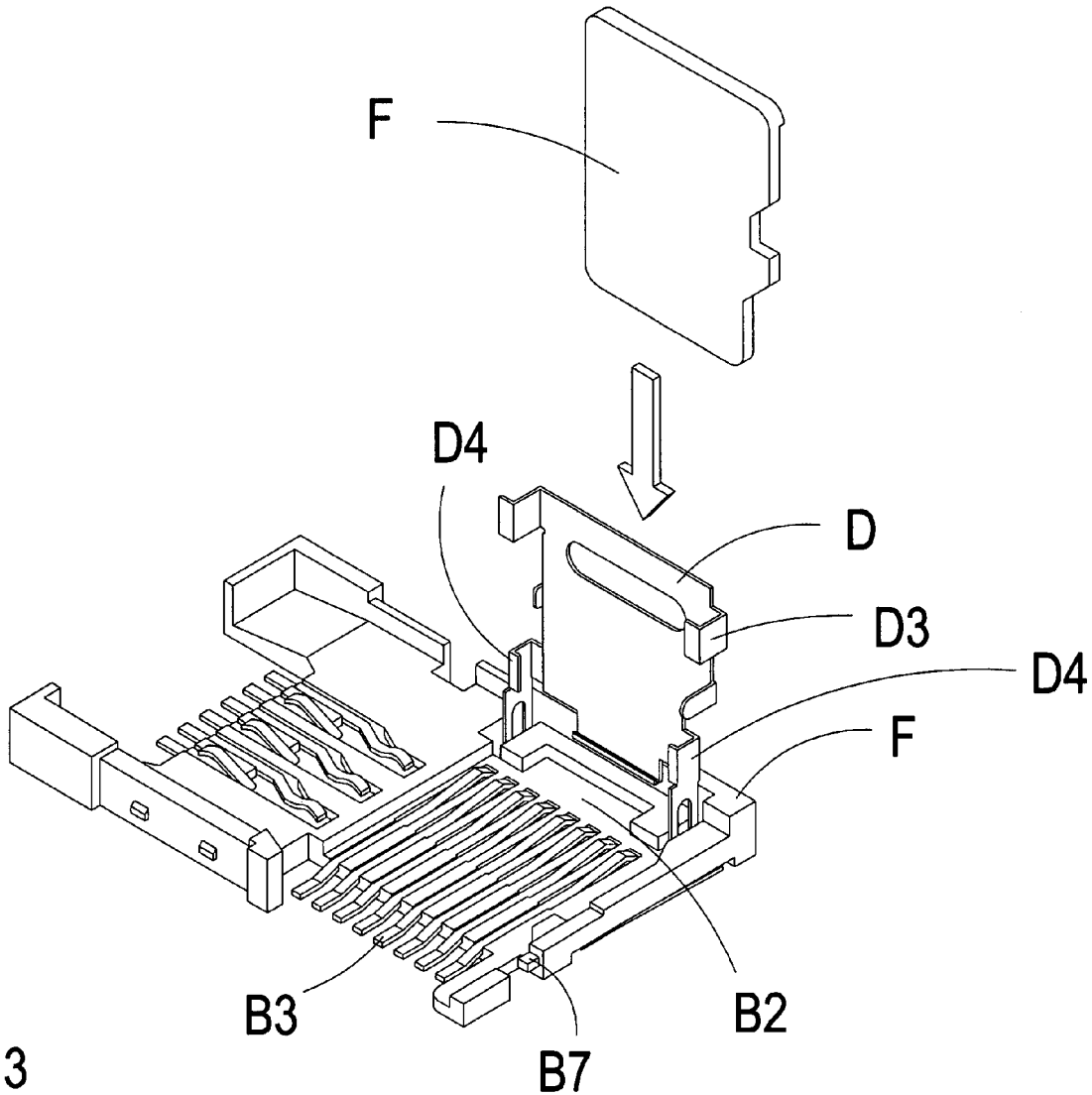
FIG. 3 shows a first elevational view of an embodiment according to the present invention.
Figure 4:
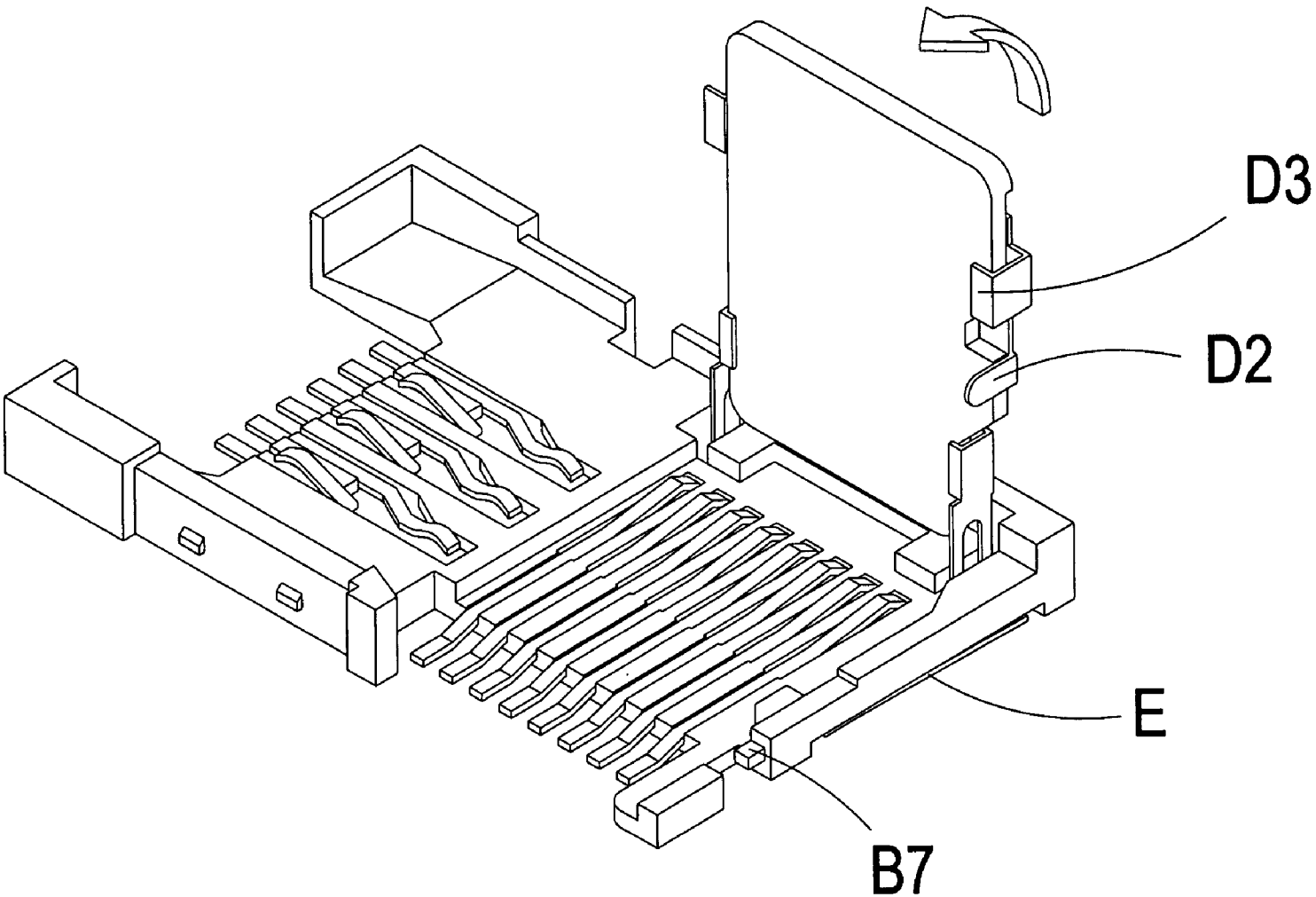
FIG. 4 shows a second elevational view of the embodiment according to the present invention.
Figure 5:
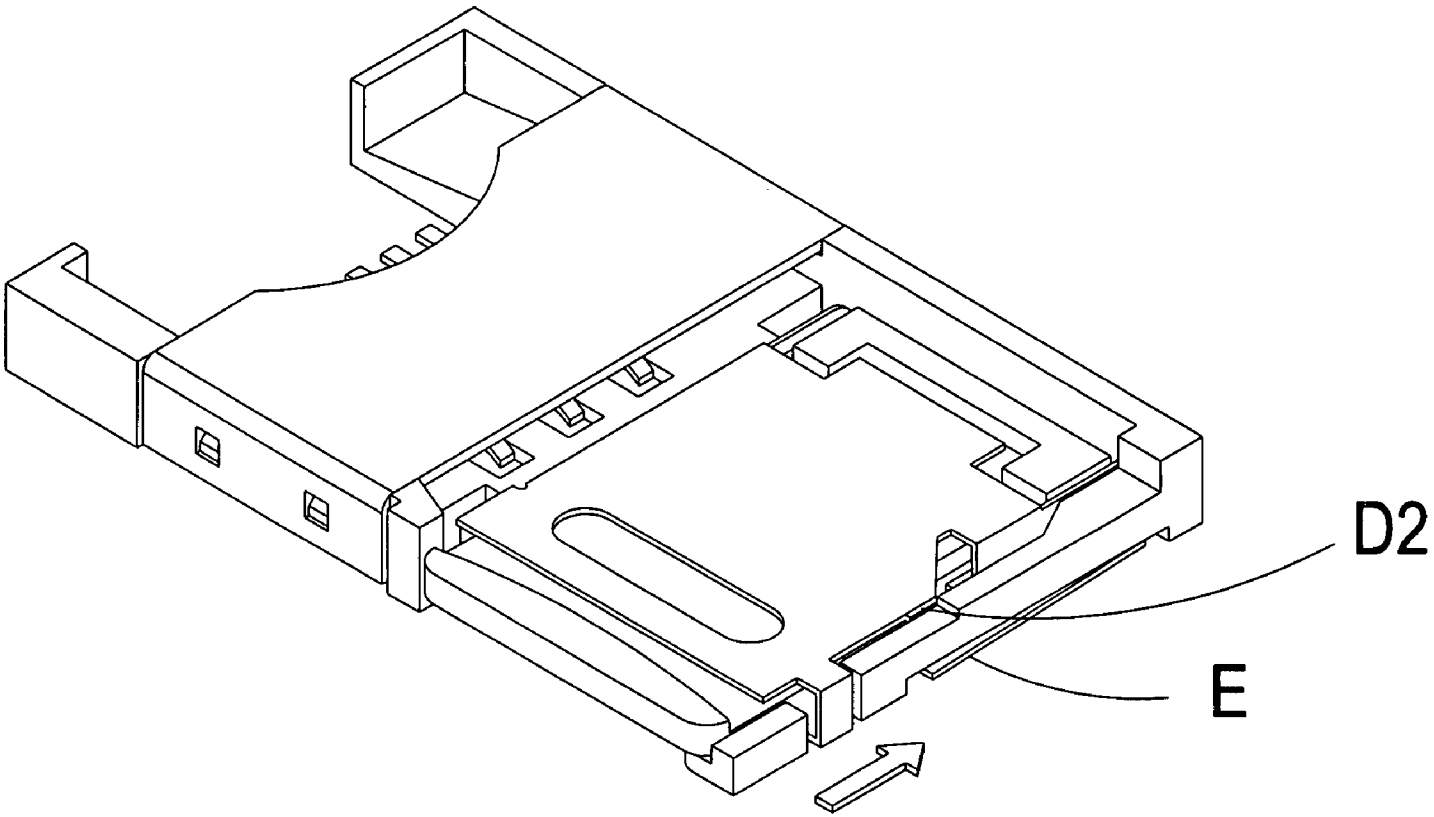
FIG. 5 shows a third elevational view of the embodiment according to the present invention.

Referring to FIG. 3, FIG. 4 and FIG. 5, which show an embodiment of the improved micro combined connector structure of the present invention, wherein a memory card F is disposed within the movable cover D, thereby enabling the memory card F to be contained between the plurality of clasp fastening members D4, whereupon the movable cover D is downwardly pressed causing the memory card F to abut against the plurality of terminals B3 within the second containing recess B2. The movable cover D is then pushed in a direction to cause the fastening member D3 of the movable cover D to slide clasp onto the protruding rail B7 of the base B, thereby effectively preventing the movable cover D from easily opening because of knocking to achieve the objective of forming a tight join.

When the movable cover D is pressed downward, the protruding piece D2 and the earth strip E make contact and produce an electrical conduction, thereby enabling the movable cover D to form an earthing state, and effectively achieving the objective of preventing interference and reducing noise.

Figure 6:
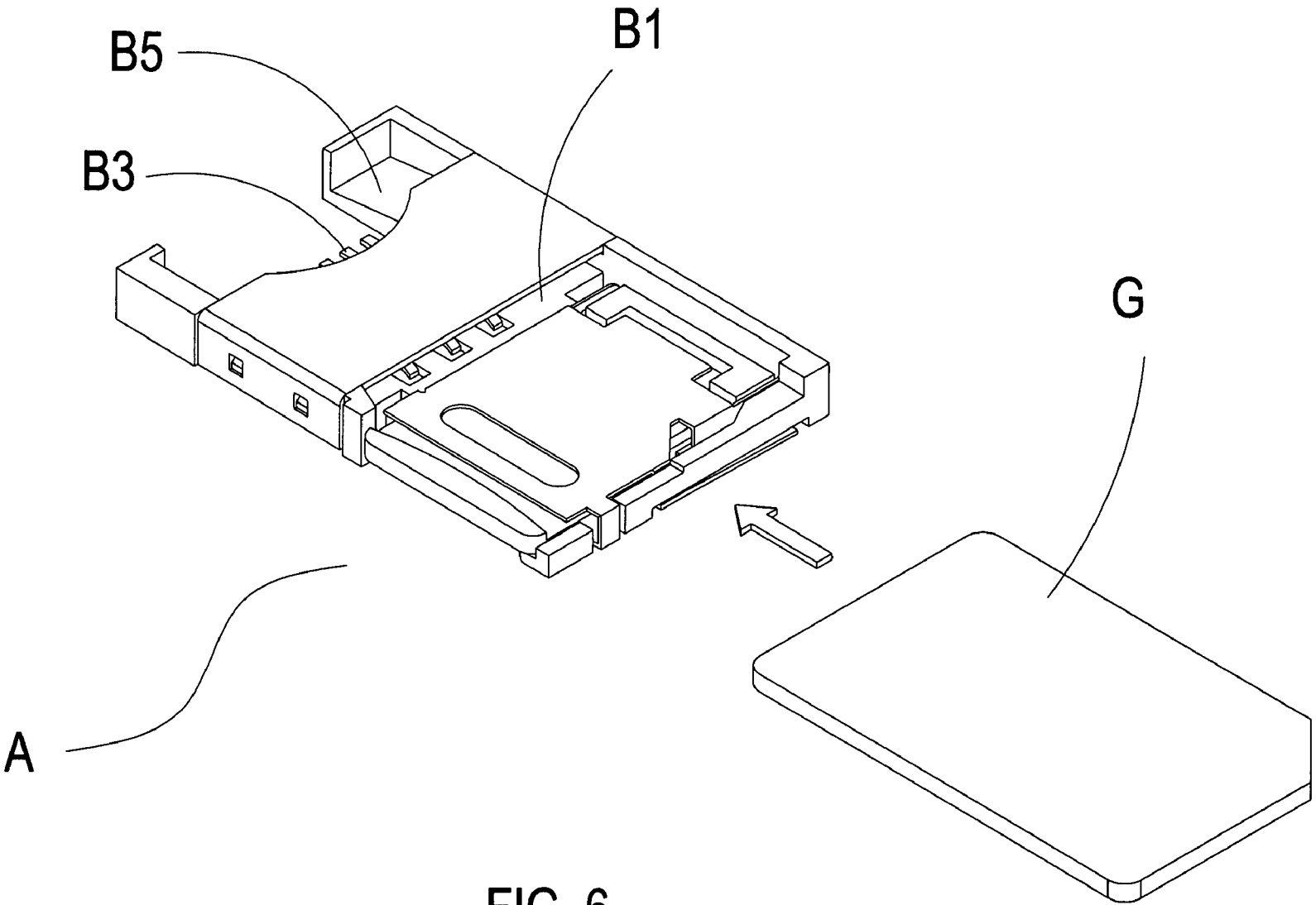
FIG. 6 shows a fourth elevational view of the embodiment according to the present invention.
Figure 7:
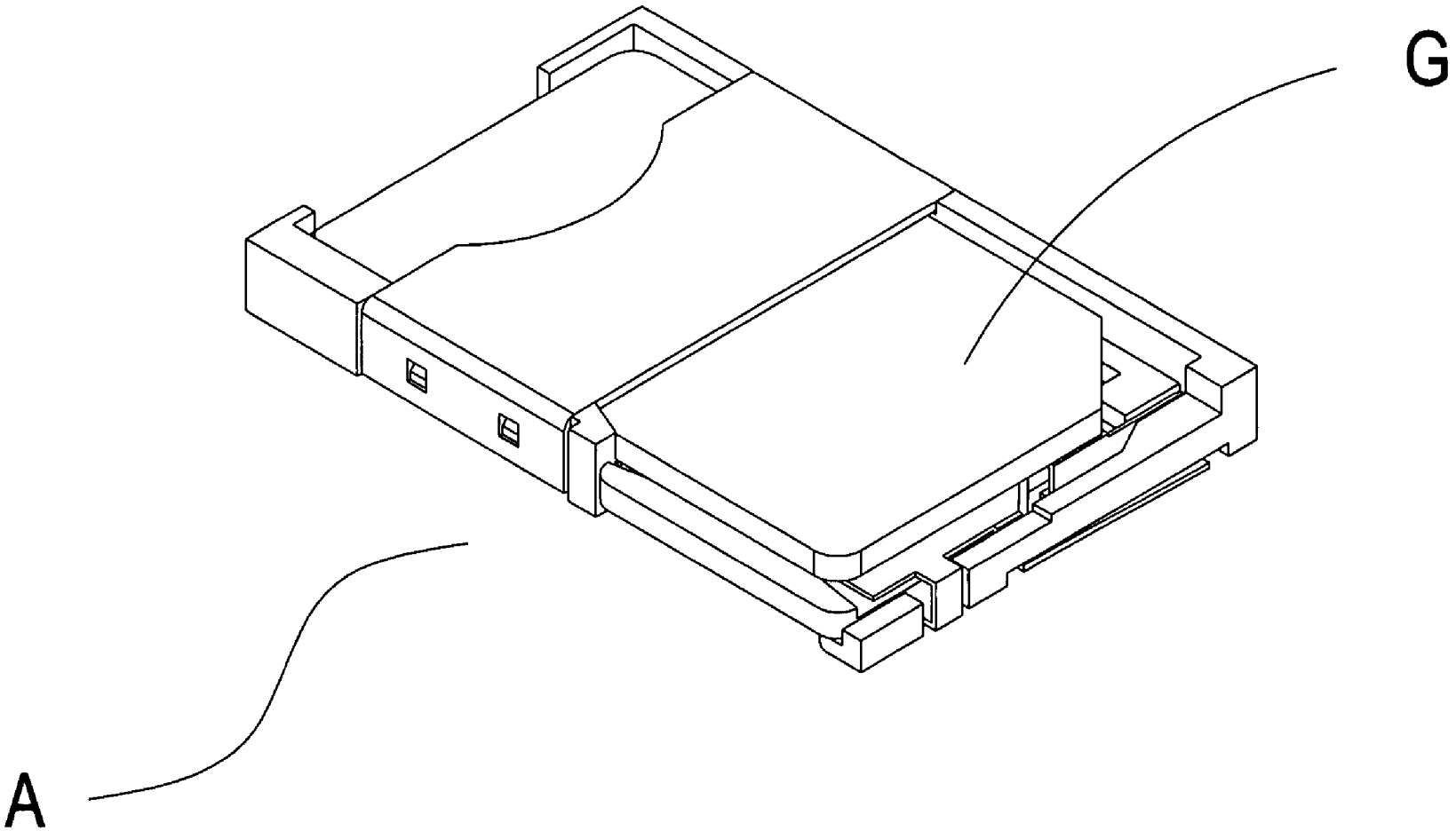
FIG. 7 shows a fifth elevational view of the embodiment according to the present invention.
Figure 8:
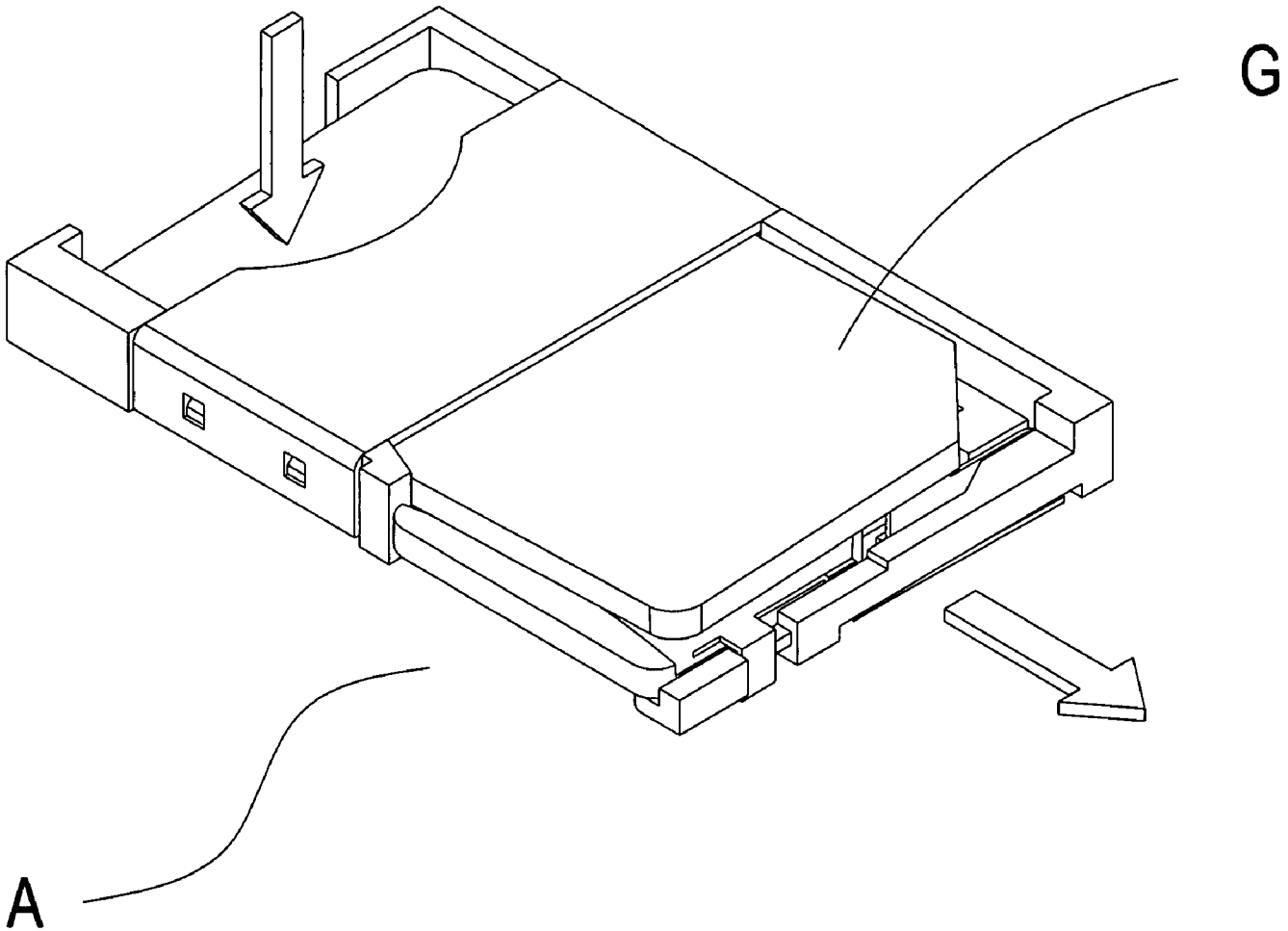
FIG. 8 shows a sixth elevational view of the embodiment according to the present invention.

Referring to FIG. 6, FIG. 7 and FIG. 8, wherein a SIM (Subscriber Identity Module) card G is inserted within the first containing recess B1 of the connector A, thereby enabling the SIM card G to form an electrical connection with the plurality of terminals B3 within the first containing recess B1, and facilitating implementation of data transmission and access using the connector A.

When extracting the SIM card G, an end of the SIM card G need only be pressed downward towards the oblique portions B5 of the first containing recess B1, thereby causing another end of the SIM card G to rise upward, whereupon the raised end is pushed to enable unimpeded extraction of the SIM card G.

The memory card F (see FIG. 3) can be a MMC (Multi Media Card), a Flash Card or related micro storage card.

In order to better explicitly disclose advancement and practicability of the present invention, a comparison with prior art is described hereinafter:

Shortcomings of Prior Art

1. Easily results in an upper cover opening due to inadvertent knocking when in use, thereby resulting in the inability to effect normal electrical connection between the memory card and terminals, or results in the memory card coming loose leading to loss thereof.

2. Lacks an earthing means, thereby easily resulting in noise interference.

Advantages of the Present Invention

1. The movable cover D is fixedly joined by means of a press fitting slide clasp method, thereby avoiding concern that the movable cover D will open due to inadvertent knocking.

2. The structure is configured with the earth strip E, thereby achieving the objective of preventing interference and reducing noise.

3. The memory card F is inserted between the movable cover D and the plurality of clasp fastening members D4, thereby increasing compactness of the memory card F when electrically connected.

4. Provided with advancement and practicability.

5. Enhances commercial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A micro combined connector structure, comprising: a base having a first containing recess adjacent to a second containing recess disposed therein, the second containing recess being recessed deeper than the first containing recess, and a plurality of terminals are respectively configured within the first containing recess and the second containing recess, a plurality of protuberances and bilateral oblique portions are located on the first containing recess, and bilateral protruding shafts and a protruding rail are located on the second containing recess;

a cover piece, which is disposed on the first containing recess, and a plurality of through holes defined in the cover piece respectively join with the corresponding protuberances of the first containing recess;

a movable cover fittingly disposed on the second containing recess, and bilateral arc holes defined in the movable cover respectively join with the corresponding protruding shafts of the second containing recess, a protruding piece extending from an edge of the movable cover; and an earth strip fittingly disposed on a side of the second containing recess of the base in a position to selectively contact the protruding piece of the movable cover;

whereby when the movable cover is closed, the protruding piece and the earth strip make contact and produce an electrical conduction, thereby enabling the movable cover to form an earthing state to achieve the objective of preventing interference and reducing noise.

2. The improved micro combined connector structure according to claim 1, wherein the plurality of terminals of the first containing recess enable a SIM (Subscriber Identity Module) card to be electrically connected thereto.

3. The improved micro combined connector structure according to claim 1, wherein the plurality of terminals of the second containing recess enable a memory card to be electrically connected thereto; when the memory card is inserted between clasp fastening members of the movable cover, then the objective of electrically connecting the memory card is achieved when the movable cover is closed.

4. The improved micro combined connector structure according to claim 3, wherein the memory card is a MMC (Multi Media Card), a Flash Card or related micro storage card.

5. The improved micro combined connector structure according to claim 1, wherein a fastening member of the movable cover functions in coordination with a protruding rail of the second containing recess to form a sliding clasp structure.

* * * * *